US012601023B2

(12) United States Patent
Frydek

(10) Patent No.: US 12,601,023 B2
(45) Date of Patent: Apr. 14, 2026

(54) METHOD FOR REPAIRING A COMPONENT BY HEAT TREATING

(71) Applicant: Caterpillar Motoren GmbH & Co. KG, Kiel (DE)

(72) Inventor: Ole Frydek, Kiel (DE)

(73) Assignee: Caterpillar Motoren GmbH & Co., KG, Kiel (DE)

( * ) Notice: Subject to any disclaimer, the term of this patent is extended or adjusted under 35 U.S.C. 154(b) by 475 days.

(21) Appl. No.: 18/026,065

(22) PCT Filed: Sep. 21, 2021

(86) PCT No.: PCT/EP2021/025357
§ 371 (c)(1),
(2) Date: Mar. 13, 2023

(87) PCT Pub. No.: WO2022/069072
PCT Pub. Date: Apr. 7, 2022

(65) Prior Publication Data

US 2023/0357873 A1 Nov. 9, 2023

(30) Foreign Application Priority Data

Oct. 1, 2020 (GB) ..... 2015613

(51) Int. Cl.
*C21D 1/42* (2006.01)
*C21D 1/55* (2006.01)
*C21D 6/00* (2006.01)

(52) U.S. Cl.
CPC ..... *C21D 1/42* (2013.01); *C21D 1/55* (2013.01); *C21D 6/00* (2013.01)

(58) Field of Classification Search
CPC ... C21D 1/42; C21D 1/55; C21D 6/00; C21D 2221/00; C21D 9/30; C21D 1/30; C21D 1/26; Y02P 10/25; G16C 60/00
(Continued)

(56) References Cited

U.S. PATENT DOCUMENTS

2010/0012648 A1* 1/2010 Gustafsson ..... C21D 1/42 148/572
2017/0259384 A1 9/2017 Boudreault et al.

FOREIGN PATENT DOCUMENTS

| | | | | |
|---|---|---|---|---|
| CN | 102399967 B | 6/2013 | | |
| CN | 106181220 A | 12/2016 | | |
| CN | 109593938 A | 4/2019 | | |
| JP | 2004107685 A | 4/2004 | | |
| KR | 20150008226 A | 1/2015 | | |
| KR | 101615037 B1 * | 4/2016 | ..... | C21D 9/24 |
| RU | 2158191 C1 | 10/2000 | | |
| RU | 2455141 C2 | 7/2012 | | |

OTHER PUBLICATIONS

KR-101615037-B1 Translation (Year: 2016).*
(Continued)

*Primary Examiner* — Danielle M. Carda

(57) ABSTRACT

The present invention refers to a method for repairing a component, in particular a component of an internal combustion engine, by heat treating, in particular tempering. The method comprises a step of obtaining a material specific reference parameter which has been determined based on at least one reference test carried out on a reference sample made of the same material as the component to be heat treated, wherein the reference parameter is indicative of a desired heat treating effect on the material of the component to be heat treated; a step of determining at least one of a heating temperature and heating duration in dependence on the obtained reference parameter; and a step of heat treating the component in accordance with at least one of the determined heating temperature and determined heating duration.

15 Claims, 5 Drawing Sheets

(58) Field of Classification Search
USPC ..... 148/511
See application file for complete search history.

(56) References Cited

OTHER PUBLICATIONS

Boudreault et al. "In situ post-weld heat treatment on martensitic stainless steel turbine runners using a robotic induction heating process to control temperature distribution", IOP Conference Series: Earth and Environmental Science, Mar. 1, 2014, vol. 22, No. 1: (Year: 2014).*
International Search Report related to Application No. PCT/EP2021/025357; reported on Jan. 5, 2022.
Great Britain Search Report related to Application No. 2015613.9; reported on Jan. 11, 2021.
E. Boudreault, et al., "In situ post-weld heat treatment on martensitic stainless steel turbine runners using a robotic induction heating process to control temperature distribution", Iop Conference Series: Earth and Environmental Science, Mar. 1, 2014, vol. 22, No. 1, p. 012016; XP055873524.
Abhishek Mitra, et al., "Influence of Temperature and Time of Post-weld Heat Treatment on Stress Relief in an 800-mm-Thick Steel Weldment", Journal of Materials Engineering and Performance, Mar. 10, 2016, vol. 25, No. 4, pp. 1384-1393, XP035658167.

* cited by examiner

METHOD FOR REPAIRING A COMPONENT BY HEAT TREATING

CROSS-REFERENCE TO RELATED APPLICATION

This Application is a 35 USC § 371 US National Stage filing of International Application No. PCT/EP2021/025357 filed on Sep. 21, 2021 which claims priority under the Paris Convention to Great Britain Patent Application No. 2015613.9 filed on Oct. 1, 2020.

TECHNICAL FIELD

The present invention refers to a method for repairing a component, in particular a component of an internal combustion engine such as a crankshaft, by subjecting the component to a heat treating procedure, in particular a tempering procedure.

TECHNOLOGICAL BACKGROUND

In large internal combustion engines, for example as used in vessels or power plants, damages or failure conditions may result in high repair expenses and long breakdowns. This applies particularly to damages of a crankshaft of such engines since this component can weight several tons, for example more than 10 tons, and therefore usually require costly disassembly, handling and repair procedures. Besides repair costs, also high breakdown costs may arise since the vessel or power plant equipped with such an engine may be affected by the breakdown as such and usually cannot be longer operated.

Recorded failures of crankshafts occurring during operation of such engines concern a damage of their bearing journals. This applies particularly to rod bearing journals which are configured for rotatably supporting a piston connecting rod at the crankshaft as well as to main bearing journals which are configured to rotatably support the crankshaft within an engine block. Such damages may be caused by an inadequate maintenance or a failure condition of the engine, in particular an inadequate or defective thermal management leading to an insufficient lubrication or cooling of the crankshaft. As a result, the crankshaft may be subjected to high friction and therefore to excessive temperatures and temperature variations, thereby unfavorably changing the metal microstructure and thus material strength characteristic of the crankshaft.

For repairing such damaged crankshafts, it is known to replace the crankshaft by a spare part. The replacement of a damaged crankshaft, however, may take weeks and may be very costly.

Further, methods are known which aim on restoring the proper condition of the damaged crankshaft. These methods, however, may be costly and it may be difficult to restore the initial and demanded material characteristics of the crankshaft. One reason for this is it may require several iterative heat treating procedures in order to restore the initial and demanded material characteristics of the crankshaft. This also requires specially trained personnel, particularly, since in the mentioned application field, engines and its components have to comply with regulatory requirements, such as rules of classification societies which establish and maintain technical standards. It thus may be difficult to verify that all regulatory requirements are met after repair and installation. Further, such an approach would require to provide corresponding heat treating devices at the site or in an area near the vessel or power plant which are suitable for heat treating such crankshafts in order to avoid long downtimes due to transportation.

SUMMARY OF THE INVENTION

Starting from the prior art, it is thus an objective to provide an improved method for repairing components of an internal combustion engine, which in particular can be performed time- and cost-efficiently when used to repair components of large internal combustion engines. Further, it is an objective to provide a use of such a method for repairing a crankshaft of an internal combustion engine.

These objectives are solved by the subject matter of the independent claims. Preferred embodiments are set forth in the present specification, the Figures, and the dependent claims.

Accordingly, a method for repairing a component, in particular a component of an internal combustion engine, by heat treating, in particular tempering, is provided. The method comprises a step of obtaining a material specific reference parameter which has been determined based on at least one reference test carried out on a reference sample made of the same or substantially the same material as the component to be heat treated, wherein the reference parameter is indicative of a desired heat treating effect on the material of the component to be heat treated; a step of determining at least one of a heating temperature and heating duration in dependence on the obtained reference parameter; and a step of heat treating the component in accordance with at least one of the determined heating temperature and the determined heating duration.

Furthermore, a use of the above described method is provided for repairing a crankshaft, in particular a bearing journal of a crankshaft, of an internal combustion engine.

BRIEF DESCRIPTION OF THE DRAWINGS

The present disclosure will be more readily appreciated by reference to the following detailed description when being considered in connection with the accompanying drawings in which.

DETAILED DESCRIPTION OF PREFERRED EMBODIMENTS

Figure 1:
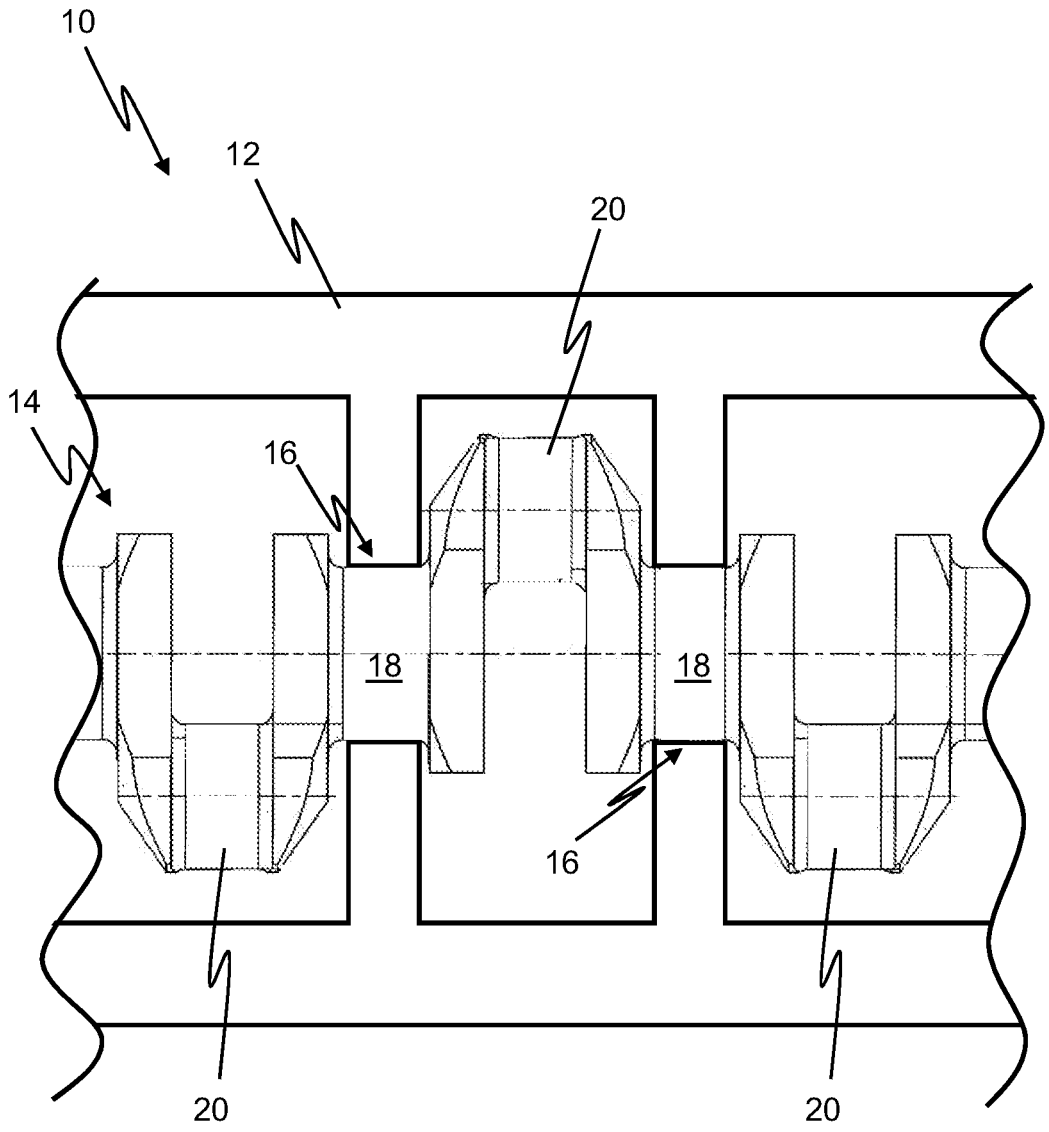
FIG. 1 schematically shows a portion of a bottom view of an internal combustion engine in a state in which it is at least partially disassembled.

In the following, the invention will be explained in more detail with reference to the accompanying Figures. In the Figures, like elements are denoted by identical reference numerals and repeated description thereof may be omitted in order to avoid redundancies.

FIG. 1 shows an internal combustion engine 10, also referred to as the "engine" in the following, provided in the form of a reciprocating engine mounted in a vessel or power plant (not shown). In particular, the engine 10 is intended to be used as a main or auxiliary engine. The engine 10 is depicted in a state in which it is at least partially disassembled such that a bottom side of the engine 10 is laid open and accessible for personnel. Specifically, as can be gathered from FIG. 1 which shows a bottom view of the engine 10, a bottom engine cover at least partially is removed from an engine block 12 such that at least a part of a crankshaft 14 of the engine 10 is exposed and accessible for repairing personnel.

The engine 10 comprises a plurality of cylinders (not shown), e.g. twelve or sixteen or eighteen cylinders, which are received in the engine block 12. In the shown configuration of the engine 10, the cylinders are arranged according to an in-line configuration or any other known cylinder configuration. Each cylinder is provided with a combustion chamber delimited by a piston accommodated in the cylinder. The pistons are configured for reciprocating and axial movement within the cylinders and are coupled to the crankshaft 14 via piston connecting rods. During operation of the engine 10, fuel and air are supplied to and ignited in each cylinder so as to produce high-temperature and high-pressure gases which apply forces to and thus axially move the corresponding pistons, thereby rotating the crankshaft 14. In this way, chemical energy is transformed into mechanical energy.

The crankshaft 14 is rotatably supported in the engine block 12 via a plurality of plain bearings 16 each of which is formed by bearing shells provided in the engine block 12 and a main bearing journal 18 of the crankshaft 14 received in the bearing shells.

Each piston is connected via a respective piston connecting rod (not shown) to the crankshaft 14. Specifically, the piston connecting rod is pivotably supported on the crankshaft via a plain bearing which is formed by bearing shells provided at an end section of the piston connecting rod and a rod bearing journal 20 provided at the crankshaft 14. In the shown configuration, each rod bearing journal 20 is interposed between two adjacent main bearing journals 18 along a longitudinal axis of the crankshaft 14. Further, the rod bearing journals 20 are radially displaced relative to the longitudinal axis of the crankshaft 14, wherein two adjacent rod bearing journals 20 are arranged on opposed sides relative to the longitudinal axis of the crankshaft 14.

The crankshaft 14 is made from an alloy steel which has been heat treated during manufacturing to meet material strength characteristics demanded by regulatory requirements. In the context of the present disclosure, the term "material strength characteristic" refers to physical properties that a material exhibits upon the application of forces. Examples of material strength characteristics are the tensile strength, hardness and fatigue limit.

Specifically, the crankshaft 14 is made from a quenched and tempered steel, e.g. 50CrMo4 steel.

During operation of the engine 10, as set forth above, a failure in the thermal management system or mechanism of the engine 10 may occur resulting in an improper lubrication and cooling of the crankshaft 14. As a result, the bearings may be subjected to excessive heat causing damage of the bearings, in particular bearing seizure or fretting, which result in reducing the fatigue strength of the crankshaft journals, i.e. the main bearing journals 18 and the rod bearing journals 20. In general, the terms "seizure bearings" or "seizure of bearings" refer to a failure which occurs when excessive heat is generated during rotation of the bearing, e.g. due to improper lubrication. In this way, components of the bearing begin to soften, thereby changing the metals microstructure and material strength characteristics of the crankshaft 14. Further, the term "fretting" describes a damage which tangibly degrades contact areas of a bearing by producing, e.g. increased surface roughness and micropits.

In the context of the present invention, it has been found that, upon operating an engine 10 for a certain period of time which is subjected to such a failure, its crankshaft 14, in particular the bearing journals 18, 20, is heated excessively by friction, i.e. to a temperature level which exceeds an intended and normal operating range. If the engine 10 is then shut down, a lubricant acting as a cooling medium usually continues to circulate within the crankcase of the engine 10. Compared to the heated bearing journals 18, 20, the lubricant may be relatively cold, e.g., having a temperature of about 90° C. which is significantly lower than the heated bearing journals 18, 20 of the crankshaft 14. Accordingly, upon being splattered with the relatively cool lubricant, the crankshaft 14 may be subjected to an excessive temperature drop. Specifically, it has been found that the thus occurring cooling event may constitute a quenching or hardening procedure and thus induces an undesired and unintended change of the metals microstructure which may result in reducing the fatigue strength of the crankshaft 14. As a result, the crankshaft 14 may no longer conform to its component requirements and thus may constitute a non-conforming component.

In the following, under reference to FIGS. 2 to 4, a method is described which is intended and suitable for repairing such non-conforming components by heat treating, in particular by tempering, to restore desired material characteristics. In general, the term "tempering" refers to a heat treating process during which a component is heated below a melting point for a certain period of time and then allowing it to cool smoothly, in particular in still air or under any other controlled conditions, such as in an oven. In this way, the process has the effect of toughening by lessening brittleness and reducing internal stresses.

Specifically, the suggested method allows for undoing the effects of the above described cooling event, i.e. the quenching or hardening to restore the initial fatigue strength of the component and thus to meet the demanded regulatory requirements.

In the following, the suggested method is described with reference to an exemplary use for repairing the rod bearing journals 20 of the crankshaft 14 which have been subjected to the above described failure event, i.e. the unintended quenching and hardening. It is apparent to a skilled person that the suggested method is not limited to this use and thus may also be used for repairing other parts of the crankshaft 14, e.g. main bearing journals 18, or other components. Further, the skilled person will understand that the method may also be used to repair components subjected to an unintended change in their material property, particularly their microstructure, which may be induced by other failure events than the above described unintended quenching and hardening.

Figure 2:
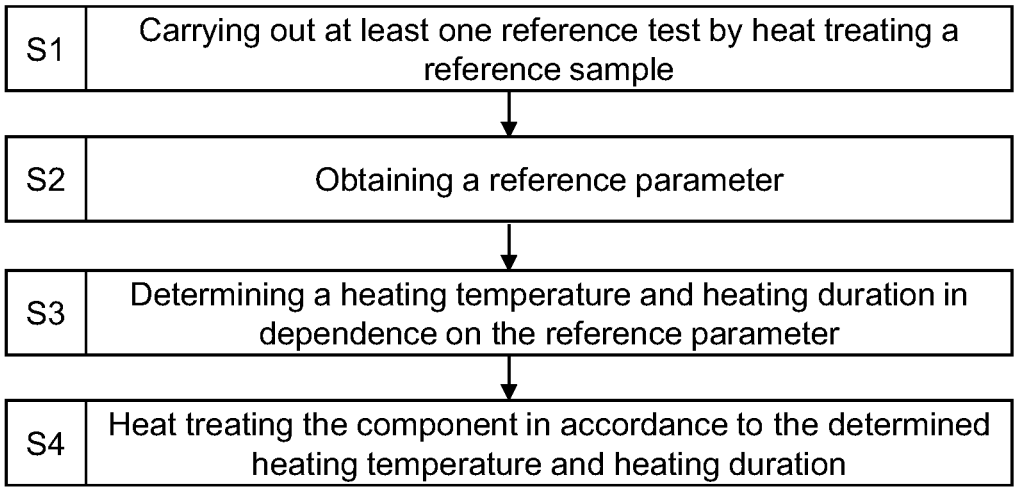
FIG. 2 shows a flow diagram depicting a method for repairing a crankshaft of the engine depicted in FIG. 1.

FIG. 2 depicts a flow diagram showing an overview of the proposed method for repairing the crankshaft 14. In a first step S1, at least one reference test is carried out during which a reference sample is heat treated to attain a desired heat treating effect and thus a desired mechanical strength characteristic of the sample.

In step S2, at least one material specific reference parameter is determined based on the at least one reference test carried out on the reference sample. The thus determined reference parameter allows to compare the heat treating procedure carried out on the reference sample with a heat treating procedure for repairing the crankshaft 14. In other words, in the proposed method, the results or findings obtained during the step of carrying out the reference test on the reference sample are utilized to select process parameter for the heat treating of the crankshaft 14 in order to attain an intended heat treating effect on the crankshaft 14. This is enabled by providing the reference parameter. In other words, by providing the reference parameter, the proposed method allows to calculate and determine process parameter for carrying out a heat treatment of the component to be repaired in order to precisely attain and restore desired material properties.

In the context of the present disclosure, the term "process parameter" refers to parameter which define a heat treating procedure. In the context of the present invention, process parameter of the heat treating step particularly refer to a heating temperature and a heating duration. Specifically, the term "heating temperature" refers to a temperature level to which the component is heated and at which it is held for a certain period of time during a heat treating step. Accordingly, the term "heating duration" refers to the period of time during which the component is held at the heating temperature.

Then, based on the thus obtained reference parameter, process parameter for carrying out the heat treating step on the component to be repaired is determined in step S3. In this step, the heating temperature and the heating duration are determined corresponding to the obtained reference parameter.

Then, in step S4, the component to be repaired is subjected to a heat treating procedure which is carried out in accordance with the determined process parameter, i.e. the heating temperature and heating duration determined in step S3.

In the following, the individual steps of the proposed method are further specified under reference to FIGS. 3 and 4.

Figure 3:
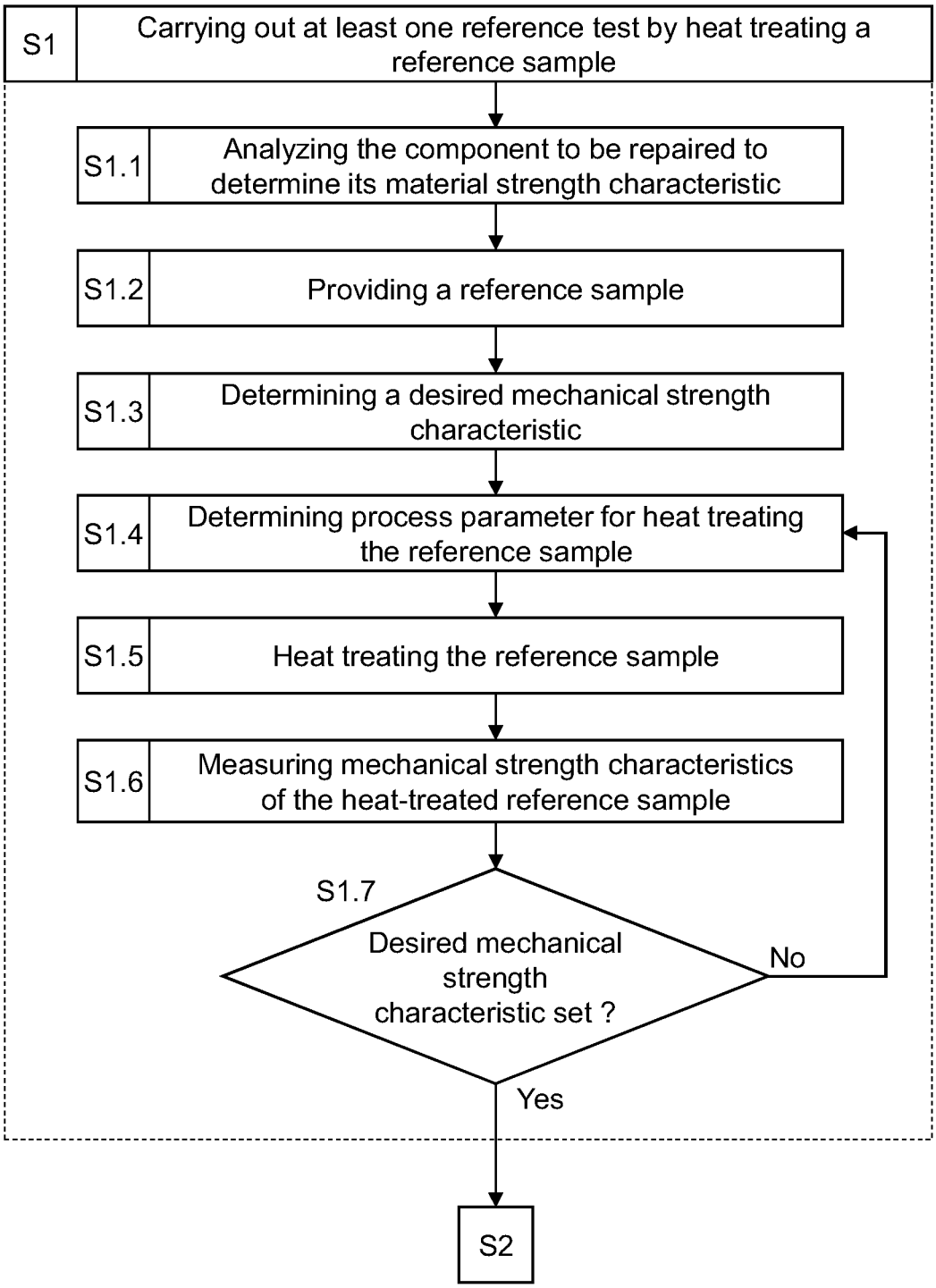
FIG. 3 shows a flow diagram describing a procedure underlying a step of the method depicted in FIG. 2 according to a first embodiment.

FIG. 3 depicts a procedure which underlies step S1 of the proposed method for carrying out the at least one reference test. In a first sub-step S1.1, the component to be repaired is analyzed to determine its material microstructure, also referred to as steel crystalline structure or crystal structure, and/or its material strength characteristics. For doing so, the component to be repaired is subjected to a measurement for determining material strength characteristics, in particular its hardness or tensile strength. In order to prevent the component from being subjected to damages during such measurement, non-destructive measurement approaches may be applied. For example, a Leeb Rebound Hardness test, also referred to as rebound testing, may be applied to determine the hardness of the crankshaft 14, i.e. the rod bearing journals 20. This method is particularly suitable for the described use of the method since it allows to measure the crankshaft 14 in its mounted state, i.e. in which it is at least partially mounted and received in the engine block 12. Alternatively, ultrasonic testing or eddy current testing methods may be used to measure hardness of the crankshaft 14 in a non-destructive manner.

Then, in sub-step 1.2, at least one reference sample is provided by a personnel carrying out the method. The reference sample is selected by the personnel such that it has the same or substantially the same material properties as the component to be repaired, in particular in view of material composition, microstructure, and material strength characteristics, in particular hardness. In other words, the reference sample is selected such that it is made of the same or substantially same material, i.e. having the same microstructure, and that it has the same or substantially the same hardness and tensile strength. For doing so, the personnel carrying out this method step may use documentations of the component to be repaired, such as a specification or a part number of the component. Further, the personnel may consult a database in which material properties linked to the component or its part number may be saved so as to attain specification and material properties related thereto. Then, a reference sample may be chosen or ordered which has the same material properties as the component to be repaired. In a further optional step, potential reference samples may be analyzed to measure their material strength characteristic which is then compared to the determined material strength characteristic of the component to be repaired which has been obtained in sub-step S1.1. If the material strength characteristic of the potential reference sample matches or substantially matches the determined material strength characteristic of the component to be repaired, the potential reference sample is selected. If this is not the case, another reference sample is chosen. This may be repeatedly performed until a proper reference sample has been found. The proposed method allows that the reference sample may be provided with a geometrical design or shape which differs from that of the component to be heat treated. Preferably, since the crankshaft 14 of the large internal combustion engine 10 is relatively heavy and bulky and thus difficult to handle by personnel, the reference sample is preferably smaller and lighter compared to the crankshaft 14. Accordingly, also the heating device for heat treating the reference sample may be provided in a smaller size which may therefore be less expensive.

In a next sub-step S1.3, a desired mechanical strength characteristic, in particular a desired hardness, is determined which refers to a characteristic to be set or restored upon heat treating the crankshaft 14. Specifically, the desired mechanical strength characteristic is determined so as to restore the initial mechanical properties of the crankshaft 14 in order to fulfill the regulatory requirements.

Then, in sub-step S1.4, process parameter for performing a heat treating procedure, in particular a tempering procedure, of the reference sample are determined. Specifically, in this step, a reference heating temperature, i.e. a tempering temperature, and a reference heating duration, i.e. tempering duration, are determined.

For obtaining a proper tempering temperature, at first, a desired tensile strength may be determined, based on which then a tempering temperature may be derived. Deriving of the tempering temperature may be performed based on a material specific tempering diagram, e.g. as shown in FIG. 4. The abscissa of the tempering diagram depicts the tempering temperature and the ordinate of the tempering diagram depicts the tensile strength. Taking into account the tempering diagram of FIG. 4, a desired minimum tensile strength may be selected. Then, a horizontal line may be drawn from the value of the tensile strength corresponding to the desired tensile strength and a crossing point with the curve depicted in the tempering diagram is determined. From the determined crossing point on the curve, a vertical line is drawn. A further crossing point of the vertical line with the abscissa is determined so as to derive the proper tempering temperature. In the exemplary use of the method, based on the diagram depicted in FIG. 4, a tempering temperature of 630° C. is determined based on the previously described approach.

Then, an initial reference heating duration may be set, for example based on empirical values. In the exemplary use of the method, the reference heating duration may be 2 h.

In a next step S1.5, the reference sample is heat treated in accordance with the reference heating temperature and reference heating duration as set in previous step S1.4. In this step, specifically, a tempering procedure is performed to decrease the hardness characteristic of the reference sample, thereby increasing its fatigue strength.

After completion of the step of tempering the reference sample, i.e. after the reference sample is properly cooled down, the mechanical strength characteristic, i.e. hardness, of the thus heat-treated reference sample is measured in sub-step S1.6. This may be performed likewise to the measurement carried out in sub-step S1.1, i.e. by performing Leeb Rebound Hardness tests.

Then, in sub-step S1.7, the measured mechanical strength characteristic of the heat-treated reference sample is compared to the desired mechanical strength characteristic determined in sub-step S1.3 to assess whether the desired mechanical strength characteristic is set. For doing so, it is determined whether the measured mechanical strength characteristic of the heat-treated reference sample lies within a tolerance range around the desired mechanical strength value. If this is not the case, the process returns to sub-step S1.4 in which at least one of the process parameter is adjusted. Then, a new reference sample, i.e. having the same initial material strength characteristics as the reference sample heat-treated previously, is heat treated in accordance with the adjusted process parameter. For example, in case the desired mechanical strength characteristic, i.e. the hardness, of the heat-treated reference sample lies above the tolerance range around the desired mechanical strength value, the reference heating duration may be increased. In this way, an iterative approach may be implemented in order to achieve a desired heat treating effect, i.e. tempering effect. Yet, if it is determined in sub-step S1.7 that the measured mechanical strength characteristic of the heat-treated reference sample lies within the tolerance range, the method proceeds to step S2.

It may be the case that the microstructure and material strength characteristics may not be known at the time when step S1 is to be performed, for example, because it is performed beforehand, i.e. before the damage of the crankshaft 14 is present. In this case, sub-steps S1.2 to S1.7 may be performed based on different reference samples each of which having a different initial mechanical strength characteristic. Then, when the damage of the crankshaft 14 occurs, sub-step S1.1 may be performed allowing to select the reference test associated to that reference sample having an initial material strength characteristic which is closest to the measured material strength characteristic of the damaged crankshaft 14.

Alternatively, sub-step S1.1 may be replaced by a step of predicting the material strength characteristics which are expected to occur due to the damage of the crankshaft 14. In this way, an actual measurement of the damaged crankshaft 14, i.e. the component to be repaired by heat treatment, may be avoided and omitted.

In step S2, as described above, the material specific reference parameter is determined based on the at least one reference test carried out in step S1. Particularly, in this step, the reference parameter is calculated as a function of the reference heating temperature and reference heating duration determined in sub-step S1.4 and verified in sub-step S1.7 for attaining a desired heat treatment effect in the reference sample.

In the shown configuration of the method, the reference parameter is the Hollomon-Jaffe parameter. In general, the Hollomon-Jaffe parameter describes a parametric relation which makes use of an equivalence between time and temperature for describing the thermally activated process of tempering for a specific material. More specifically, the Hollomon-Jaffe parameter defines a relation between heating duration and heating temperature for obtaining a desired heat treating effect, in particular a desired tempering effect. In this way, the Hollomon-Jaffe parameter allows to compare different tempering treatments, i.e. which differ in heating duration and heating temperature, in view of their tempering effect.

The present invention is not limited to the Hollomon-Jaffe parameter. Rather, any suitable parameter may be used which allows for comparing different heat treating procedures, i.e. which differ in view of heating temperature and heating duration, and their resulting heat treating effects on specific materials. In other words, any parameter may be used as the reference parameter which defines a relation between or an equivalence of the heating temperature and heating duration for obtaining a desired heat treating effect. As such, for example, the Larson-Miller parameter may be used as the reference parameter which describes an equivalence of time and temperature for describing a thermally activated process for a specific material.

In the proposed method, the Hollomon-Jaffe parameter is defined and calculated as:

$$P = \left(T\left(\log(t + \frac{T}{k * K1(C - \log(K1))} + \frac{T}{k * K2(C - \log(K2))}) + C\right)\right) \times 10^{-3}, \quad (1)$$

wherein P refers to the reference parameter, i.e. the Hollomon-Jaffe parameter, T refers to a heating temperature [K], t refers to a heating duration [h], C refers to a constant, i.e. material constant of the heat treated component or the component to be heat treated, k refers to a coefficient, K1 refers to a heating rate of the component [K/h], and K2 refers to a cooling rate of the component [K/h]. By doing so, the reference parameter is defined and calculated as a function of the heating temperature and the heating duration, a heating rate and a cooling rate.

The parameter C is a material specific parameter and thus depends on the material of the component, i.e. its chemical composition, wherein for the shown configuration of the crankshaft 14 a value of 20 is used.

The heating rate and the cooling rate refer to parameter which depend on the configuration of a heating device used for heat treating a part to be heat-treated. Specifically, these parameter indicate how fast a temperature changes in the component to be heat treated upon being heated by the heating device. In the reference test, a heating device is used, in particular an oven, which has a heating rate of about 550 K/h and a cooling rate of about 45 K/h. The values of the heating rate and cooling rate may be measured upon operating the heating device.

In the shown configuration of the method, the coefficient k is determined based on empirical values and has a value of 2.3.

Accordingly, for calculating the reference parameter P, the above equation (1) is used in which the reference heating temperature is inserted for the parameter T and the reference heating duration obtained in step S1 is inserted for the parameter t to calculate a value for the reference parameter P which is associated to the desired heat treating effect. As such, the calculated reference parameter P defines a set of value pairs each of which refers to the same tempering effect. Specifically, these value pairs are constituted by a heating temperature value and a corresponding heating duration value.

Then, in step S3, process parameters for heat treating, in particular tempering, the crankshaft 14 are determined. Specifically, for doing so, a heating temperature and a heating duration are calculated in dependence on the calculated reference parameter P. According to one approach, at first, a suitable heating temperature may be determined likewise to the approach described in connection with sub-step S1.4, i.e. based on the material specific tempering diagram depicted in FIG. 4. Then, the heating duration is determined as a function of the determined heating temperature and the determined reference parameter. Specifically, this is performed based on above equation (1). For doing so, at first, the heating rate K1 and the cooling rate K2 are determined for the heating device and configuration used for heat treating the crankshaft 14 in step S4. Further, the equation (1) is solved for the parameter t and then the determined heating temperature T, the determined reference parameter P and the adapted heating and cooling rates K1, K2 are inserted to calculated the heating duration t.

Alternatively, at first, a suitable heating duration may be determined. Then, the heating temperature is determined as a function of the determined heating duration t and the determined reference parameter P, specifically by solving the above equations (1) for the parameter T and then inserting the determined heating duration t, the determined reference parameter P and the adapted heating and cooling rates K1, K2 to calculate the heating temperature T.

In the next step S4, the crankshaft 14, i.e. its rod bearing journals 20, are subjected to the heat treating procedure which is performed based on the process parameter determined in step S3, i.e. the determined heating temperature and heating duration. For doing so, the step of heat treating is performed by applying inductive heating. Accordingly, an induction heating device is used as the heating device. The induction heating device is configured to heat an electrically conducting object by electromagnetic induction, i.e. through heat generated in the object by eddie currents. Compared to other heating devices, such as heating devices having a heat source configured to transfer heat by convection, the heating may be selectively performed, thereby avoiding that other parts of the engine 10 or the crankshaft 14 are unintendedly affected by the heat treatment. By using the induction heating device, the step of heat treating the component may be performed with a heating rate of about 50 K/h and a cooling rate of about 30 K/h.

For carrying out the heat treating step, a conductor of the induction heating device is arranged around each rod bearing journal 20 of the crankshaft 14. For doing so, the piston connecting rods of the corresponding pistons are released from the rod bearing journals 20, before the conductors are arranged around the rod bearing journals 20. The conductors are connected to an electronic oscillator that passes high-frequency alternating current through the conductors which form an electromagnet. The thus generated rapidly alternating magnetic field penetrates and thereby heats the rod bearing journals 20. The general configuration and function of such an induction heating device is well known to the skilled person and is therefore not further specified.

Step S4 of heat treating the component is performed in a state in which the crankshaft 14 is in the mounted state in which it is partially mounted and received within the engine block 12. This is enabled by using the induction heating device for performing the step of heat treating the rod bearing journals 20. Of course, step S4 may also be performed in a state in which the component to be repaired is removed from the engine.

Figure 4:
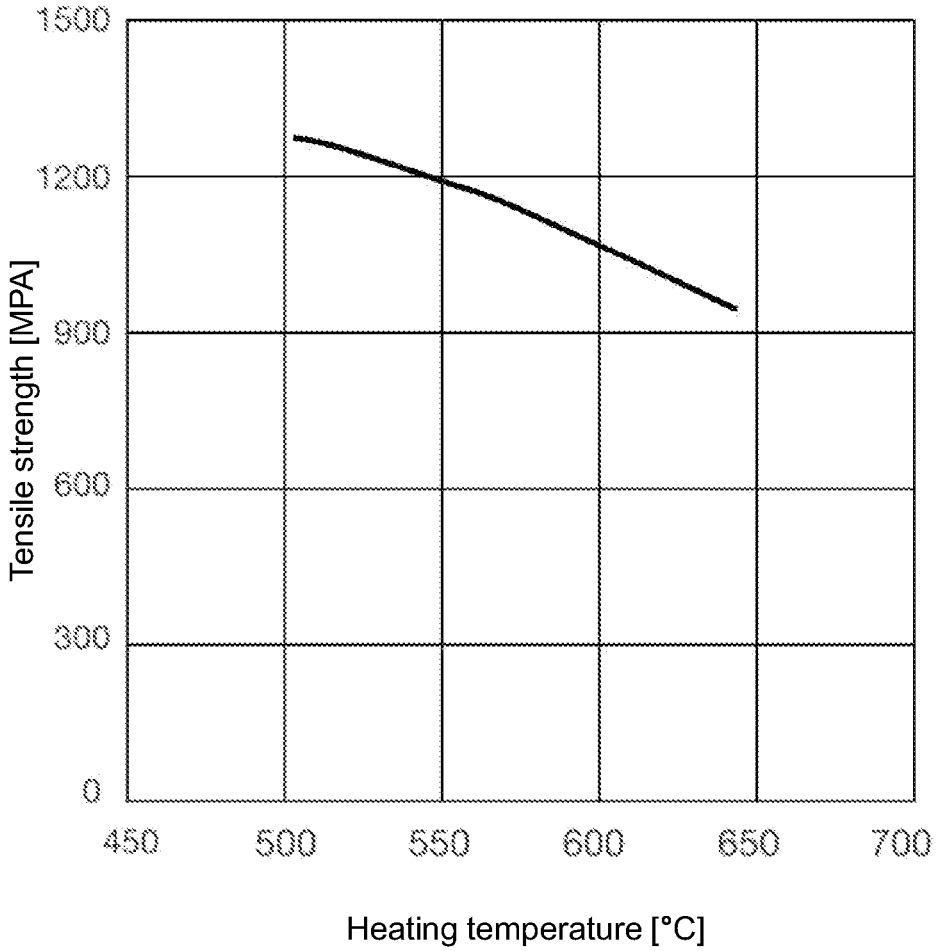
FIG. 4 shows a material specific tempering diagram.
Figure 5:
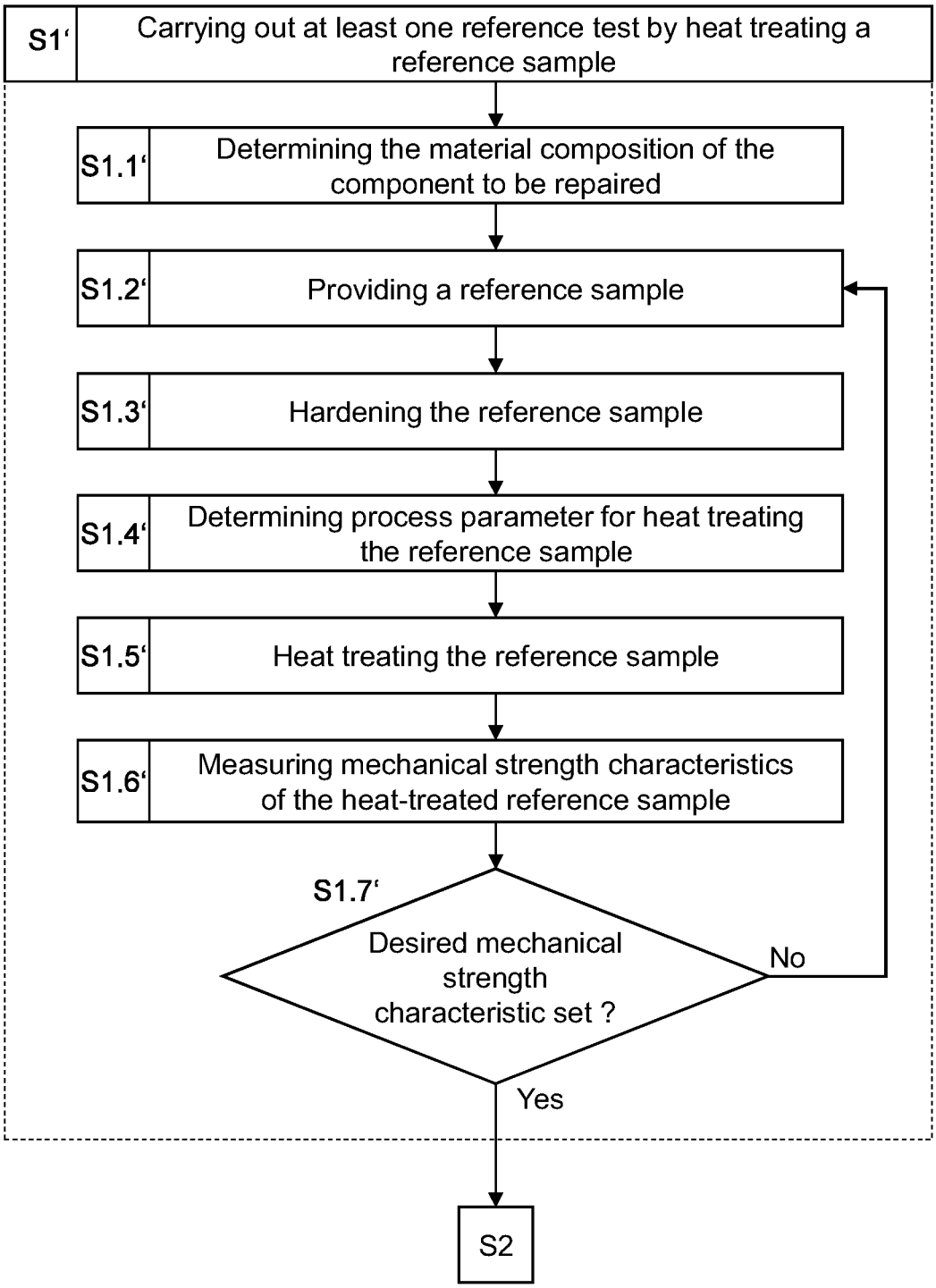
FIG. 5 shows a flow diagram describing a procedure underlying the step of the method depicted in FIG. 2 according to a second embodiment.

FIG. 5 refers to a second embodiment of the method in which the step S1 for carrying out the at least one reference test differs compared to the embodiment described in connection with FIGS. 2 to 4, while method steps S2 to S4 are performed correspondingly. Specifically, FIG. 5 depicts the procedure underlying the step S1' for carrying out the at least one reference test according to the second embodiment.

In a first sub-step S1.1', the material composition of the component to be repaired is determined. In other words, in this step, it is determined from which material, e.g. from which alloy, the component to be repaired is made.

Then, in sub-step S1.2', a reference sample is provided which is made from the same material composition, i.e. material or alloy, as determined in sub-step S1.1'. In other words, the reference sample is provided such that it is made from the same material as the component to be repaired.

In sub-step S1.3', the reference sample is subjected to a hardening procedure. This is performed by heating the reference sample, for example in an oven, to a preset temperature, before it is quenched, for example by immersing it into water or oil.

Then, in sub-step S1.4', process parameter for performing a heat treating procedure, in particular a tempering procedure, of the reference sample are determined. Specifically, in this step, a reference heating temperature, i.e. a tempering temperature, and a reference heating duration, i.e. tempering duration, are determined. For doing so, the reference sample may be put into an oven.

For obtaining a proper tempering temperature, at first, a desired tensile strength may be determined, based on which then a tempering temperature may be derived as described above in connection with sub-step S1.4 and FIG. 4. Accordingly, a material specific tempering diagram may be used which is specific for the determined material or material composition, i.e. determined in sub-step S1.1.

In sub-step S1.5', the reference sample is subjected to the heat treating procedure which is performed in accordance to the process parameter determined in sub-step 1.4'.

Then, in sub-step S1.6', the heat-treated reference sample is subjected to a mechanical strength measurement to determine the mechanical strength characteristic of the reference sample. For doing so, the reference sample may be subjected to a tensile strength measurement. Specifically, the reference sample may be processed to generated a tensile test specimen, e.g. by metal cutting, which is then subjected to a tensile strength test.

Then, in sub-step S1.7', the measured mechanical strength characteristic of the heat-treated reference sample is compared to the desired mechanical strength characteristic, i.e. desired tensile strength, to assess whether the desired mechanical strength characteristic is set. For doing so, it is determined whether the measured mechanical strength characteristic of the heat-treated reference sample lies within a tolerance range around the desired mechanical strength value. If this is not the case, the process returns to sub-step S1.2' to repeat sub-steps S1.2' to S1.7'. In this way, an iterative approach may be implemented in order to achieve a desired heat treating effect, i.e. tempering effect. Yet, if it is determined in sub-step S1.7 that the measured mechanical strength characteristic of the heat-treated reference sample lies within the tolerance range, the method proceeds to step S2. In step S2, as described above, the material specific reference parameter is determined based on the at least one reference test carried out in step S1'. Particularly, in this step, the reference parameter is calculated as a function of the reference heating temperature and reference heating duration determined in sub-step S1.4' and verified in sub-step S1.7' for attaining a desired heat treatment effect in the reference sample.

According to this embodiment, steps S1' and S2 may be performed beforehand, i.e. before a damage of the crankshaft 14 occurs, for different alloys or materials. In this way, a material specific parameter may be predetermined for every material or alloy which is in use among different engines or products. Accordingly, when a component is to be repaired, the heat treatment procedure may be performed without requiring to perform steps S1' and S2 since these steps have already been performed beforehand.

It will be obvious for a person skilled in the art that these embodiments and items only depict examples of a plurality of possibilities. Hence, the embodiments shown here should not be understood to form a limitation of these features and configurations. Any possible combination and configuration of the described features can be chosen according to the scope of the invention. This is in particular the case with respect to the following optional features which may be combined with some or all embodiments, items and/or features mentioned before in any technically feasible combination.

Specifically, a method for repairing a component, in particular a component of an internal combustion engine, by heat treating, in particular tempering, may be provided. The method may comprise a step of obtaining a material specific reference parameter which has been determined based on at least one reference test carried out on a reference sample made of the same or substantially the same material as the component to be heat treated, wherein the reference parameter is indicative of a desired heat treating effect on the material of the component to be heat treated; a step of determining at least one of a heating temperature and heating duration in dependence on the obtained reference parameter; and a step of heat treating the component in accordance with at least one of the determined heating temperature and determined heating duration.

The suggested approach, as set forth above, allows to compare the heat treating procedure carried out on the reference sample with a heat treating procedure of the component to be repaired. By providing the reference parameter, the results or findings obtained based on the reference test are utilized to determine process parameter for heat treating the component to be repaired in order to attain an intended heat treating effect. In this way, a heat treating effect to be attained during the heat treating step may be precisely predicted and thus controlled, thereby providing a time- and cost-efficient method for repairing a component by heat treating.

The proposed method may be used to repair components of an internal combustion engine, in particular large internal combustion engines as used in power plants or vessels as main or auxiliary engines. However, the method is not limited to this application and thus may be used for repairing other components by heat treating. Specifically, the method may be used to repair components which have been subjected to an unintended hardening and/or quenching procedure during operation.

The reference parameter may define a relation between the heating temperature and heating duration for obtaining the desired heat treating effect. Further, the reference parameter may define a set of value pairs each of which is constituted by a heating temperature value and a corresponding heating duration value. Specifically, the reference parameter may be defined as a function of the heating temperature and the heating duration. Accordingly, the reference parameter may be expressed as:

$$P=f(T,t), \tag{2}$$

wherein P refers to the reference parameter, $f$ indicates a mathematical function, T refers to a heating temperature [K] and t refers to a heating duration [h].

According to a further development, the reference parameter may be indicative of or may be the Larson-Miller parameter. Alternatively or additionally, the reference parameter may be indicative of or may be the Hollomon-Jaffe parameter, in particular when in the step of heat treating the component is subjected to a tempering procedure. Specifically, the reference parameter may be defined or be expressed as:

$$P=f(T(\log(t)+C)), \tag{3}$$

wherein P refers to the reference parameter, $f$ indicates a mathematical function, T refers to the heating temperature, t refers to the heating duration, and C refers to a constant, in particular material constant of the component to be repaired.

According to a further development, the reference parameter is defined as a function of the heating temperature, the heating duration, a heating rate and a cooling rate of a device used for heat treating a part to be heat-treated, e.g. the reference sample and the component to be repaired. Specifically, the reference parameter may be defined or may be expressed as:

$$P = f\left(T\left(\log(t + \frac{T}{k * K1(C - \log(K1))} + \frac{T}{k * K2(C - \log(K2))}) + C\right)\right), \tag{4}$$

wherein P refers to the reference parameter, in particular the Hollomon-Jaffe parameter, $f$ indicates a mathematical function, T refers to the heating temperature, t refers to the heating duration, C refers to a constant, in particular material constant of the component, k refers to a coefficient, K1 refers to a heating rate of a heating device, and K2 refers to a cooling rate of the heating device.

In a further development, the reference sample and the component to be repaired may have the same or substantially the same material microstructure and/or material strength characteristic. Further, the reference sample and the component to be repaired may differ in terms of their geometric design.

According to a further development, the method may comprise a step of carrying out the at least one reference test. The step of carrying out the at least one reference test may have the sub-step of providing the reference sample having the same or substantially the same material composition and/or microstructure and/or material strength characteristic, in particular hardness, as the component to be repaired.

Alternatively or additionally, the step of carrying out the at least one reference test may have to sub-step of determining a desired mechanical strength characteristic, in particular a desired hardness, to be set.

Alternatively or additionally, the step of carrying out the at least one reference test may have to sub-step of heat treating the reference sample at a predetermined reference heating temperature and reference heating duration to set the desired mechanical strength characteristic.

Alternatively or additionally, the step of carrying out the at least one reference test may have to sub-step of measuring at least one mechanical strength characteristic of the heat-treated reference sample to determine whether the heat-treated reference sample has the desired mechanical strength characteristic.

Further, if the measured mechanical strength characteristic does not correspond to the desired mechanical strength characteristic, the predetermined reference heating temperature and reference heating duration may be adjusted and the sub-step of heat treating a reference sample may again be carried out in accordance with the adjusted reference heating temperature and the adjusted reference heating duration. Further, if the measured mechanical strength characteristic corresponds to the desired mechanical strength characteristic, a sub-step of calculating the reference parameter in dependence on the reference heating temperature and the reference heating duration may be performed.

According to a further development, the step of determining at least one of the heating duration and heating temperature may be performed such that the heating duration is determined as a function of a desired heating temperature and the reference parameter or that the heating temperature is determined as a function of a desired heating duration and the reference parameter.

Further, the step of heat treating may be performed by applying inductive heating. Alternatively or additionally, the step of heat treating the component may be performed in a state in which it is at least partially mounted to an assembly unit, in particular an internal combustion engine.

Furthermore, the above described method may be used for repairing a crankshaft, in particular a bearing journal of a crankshaft, of an internal combustion engine.

INDUSTRIAL APPLICABILITY

With reference to the Figures and their accompanying description, a method for repairing a component by heat treating is proposed. The method as mentioned above is applicable to repair components of an internal combustion engine, such as a crankshaft. The proposed method may replace conventional repair methods for repairing such components.

Specifically, compared to conventional repair methods, the proposed method allows to reliably predict and thus control a desired heat treating effect to be attained during a heat treating procedure for repairing the component. In this way, a time- and cost-efficient method for repairing a component by heat treating may be provided in which process parameter for the heat treating procedure may be reliably pre-defined, i.e. without requiring to subject the component to be repaired to pretests or several iterative heat treating procedures.

The invention claimed is:

1. A method for repairing a component of an internal combustion engine by tempering, the method comprising:

obtaining a material specific reference parameter which has been determined based on at least one reference test carried out on a reference sample made of a same material as the component to be tempered, wherein the reference parameter defines a relation between a heating temperature and a heating duration for obtaining a desired tempering effect on the component to be tempered, wherein the heating duration refers to a period of time during which the component is held at the heating temperature;

determining at least one of the heating temperature and heating duration in dependence on the obtained reference parameter; and tempering the component in accordance with at least one of the determined heating temperature and determined heating duration.

2. The method according to claim 1, wherein the reference parameter defines a relation between the heating temperature and heating duration for obtaining the desired heat treating effect.

3. The method according to claim 1, wherein the reference parameter defines a set of value pairs each of which includes a heating temperature value and a corresponding heating duration value.

4. The method according to claim 1, wherein the reference parameter is defined as a function of the heating temperature and the heating duration.

5. The method according to claim 1, wherein the reference parameter includes a Larson-Miller parameter or a Hollomon-Jaffe parameter.

6. The method according to claim 1, wherein the reference parameter is defined as:

$$P=f(T(\log(t)+C)),$$

wherein P refers to the reference parameter, f indicates a mathematical function, T refers to the heating temperature, t refers to the heating duration, and C refers to a material constant of the component to be repaired.

7. The method according to claim 1, wherein the reference parameter is defined as a function of the heating temperature, the heating duration, a heating rate and a cooling rate.

8. The method according to claim 7, wherein the reference parameter is defined as:

$$P = f\left(T\left(\log(t + \frac{T}{k * K1(C - \log(K1))} + \frac{T}{k * K2(C - \log(K2))}) + C\right)\right),$$

wherein P refers to the reference parameter, f indicates a mathematical function, T refers to the heating temperature, t refers to the heating duration, C refers to a material constant of the component, k refers to a coefficient, K1c refers to a heating rate, and K2 refers to a cooling rate.

9. The method according to claim 1, wherein the reference sample and the component to be repaired have a same material microstructure or material strength characteristic.

10. The method according to claim 1, wherein the reference sample and the component to be repaired differ in terms of their geometric design.

11. The method according to claim 1, further comprising carrying out the at least one reference test, wherein carrying out the at least one reference test includes:

providing the reference sample having a same material composition or microstructure or material strength characteristic as the component to be repaired;

determining a desired mechanical strength characteristic to be set;

heat treating the reference sample at a predetermined reference heating temperature and reference heating duration to set the desired mechanical strength characteristic;

measuring mechanical strength characteristics of the heat-treated reference sample to determine whether the heat-treated reference sample has the desired mechanical strength characteristic;

if the measured mechanical strength characteristic does not correspond to the desired mechanical strength characteristic, adjusting the predetermined reference heating temperature and reference heating duration, wherein heat treating a reference sample is again carried out in accordance with the adjusted reference heating temperature and reference heating duration; and if the measured mechanical strength characteristic corresponds to the desired mechanical strength characteristic, calculating the reference parameter in dependence on the reference heating temperature and the reference heating duration.

12. The method according to claim 1, wherein the determining the at least one of the heating duration and heating temperature is performed such that the heating duration is determined as a function of a desired heating temperature and the reference parameter or that the heating temperature is determined as a function of a desired heating duration and the reference parameter.

13. The method according to claim 1, wherein the step of heat treating is performed by applying inductive heating.

14. The method according to claim 1, wherein the step of heat treating the component is performed while the component is in a mounted state in which it is at least partially mounted to an assembly unit.

15. The method according to claim 1, wherein the component includes a bearing journal of a crankshaft of an internal combustion engine.

* * * * *